US008689746B2

(12) United States Patent
Boegershausen

(10) Patent No.: US 8,689,746 B2
(45) Date of Patent: Apr. 8, 2014

(54) DEVICE FOR THE VARIABLE ADJUSTMENT OF VALVE LIFT CURVES OF GAS EXCHANGE VALVES OF AN INTERNAL COMBUSTION ENGINE

(75) Inventor: Mathias Boegershausen, Puschendorf (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 493 days.

(21) Appl. No.: 13/026,371

(22) Filed: Feb. 14, 2011

(65) Prior Publication Data

US 2011/0197835 A1 Aug. 18, 2011

(30) Foreign Application Priority Data

Feb. 15, 2010 (DE) ..... 10 2010 008 001

(51) Int. Cl.
*F01L 9/02* (2006.01)

(52) U.S. Cl.
USPC ..... 123/90.12; 123/90.15; 123/90.17

(58) Field of Classification Search
USPC ..... 123/90.15, 90.17, 90.31, 90.12
See application file for complete search history.

(56) References Cited

U.S. PATENT DOCUMENTS

| | | | | |
|---|---|---|---|---|
| 5,778,841 | A * | 7/1998 | Reedy et al. | 123/90.34 |
| 8,113,160 | B2 * | 2/2012 | Methley | 123/90.17 |
| 8,146,551 | B2 * | 4/2012 | Pluta | 123/90.17 |
| 2008/0184950 | A1 * | 8/2008 | Lawrence et al. | 123/90.17 |
| 2009/0272347 | A1 * | 11/2009 | Schafer et al. | 123/90.17 |

FOREIGN PATENT DOCUMENTS

| | | | | |
|---|---|---|---|---|
| DE | 42 18 082 | A1 | 12/1993 | |
| DE | 102 28 354 | A1 | 1/2004 | |
| DE | 10 2005 052 481 | A1 | 5/2007 | |
| DE | 10 2005 060 111 | A1 | 7/2007 | |
| EP | 0 931 912 | A2 | 7/1999 | |
| WO | WO 2008140897 | A1 * | 11/2008 | F01L 1/344 |

* cited by examiner

*Primary Examiner* — Thai Ba Trieu
*Assistant Examiner* — Thomas Olszewski
(74) *Attorney, Agent, or Firm* — Lucas & Mercanti, LLP

(57) ABSTRACT

A device for the variable adjustment of valve lift curves of gas exchange valves of an internal combustion engine, which has a hydraulic consumer, a camshaft and a volume accumulator. The camshaft is arranged in the internal combustion engine in a rotatably mounted manner by camshaft bearings. The interior of the camshaft has a cavity. Bores are formed on the camshaft in the region of the camshaft bearings and, via the bores, the cavity communicates with the camshaft bearings. The volume accumulator is arranged in the cavity and has a housing which extends in a region of at least one camshaft bearing.

8 Claims, 3 Drawing Sheets

DEVICE FOR THE VARIABLE ADJUSTMENT OF VALVE LIFT CURVES OF GAS EXCHANGE VALVES OF AN INTERNAL COMBUSTION ENGINE

This application claims priority of DE 10 2010 008 001.2, which was filed Feb. 15, 2010 and is incorporated by reference herein.

FIELD OF THE INVENTION

The invention relates to a device for the variable adjustment of valve lift curves of gas exchange valves of an internal combustion engine, with a hydraulic consumer, a camshaft and a volume accumulator. The camshaft is arranged in the internal combustion engine in a rotatably mounted manner by means of camshaft bearings, the interior of the camshaft has a cavity, bores are formed on the camshaft in the region of the camshaft bearings, via which bores the cavity communicates with the camshaft bearings, and the volume accumulator is arranged in the cavity and has a housing which extends in a region of at least one camshaft bearing.

BACKGROUND OF THE INVENTION

In modern internal combustion engines, devices are used for the variable adjustment of valve lift curves of gas exchange valves in order to reduce the consumption of fuel and the emissions of the internal combustion engine and to have a positive influence on the torque and power of said internal combustion engine. Devices are known in this connection, by means of which the lift of the gas exchange valves can be matched to the respective operating situation. A device of this type is known, for example, from EP 0 931 912 A2. This hydraulic valve-actuating device has a camshaft, the cams of which act on a hydraulic slave cylinder of a pressure medium volume. At the same time, a master cylinder, which is actuated by the pressure medium volume, acts on the gas exchange valve. The gas exchange valve is therefore not actuated directly by the cam but rather via a pressure medium volume connected in-between. Said pressure medium volume can be changed by means of a hydraulic valve and a volume accumulator such that the lift height of the gas exchange valve can be configured so as to be variable. The pressure medium volume therefore acts as a hydraulic consumer to which and from which pressure medium is supplied and removed during operation of the internal combustion engine.

A further known device serves to displace the timing, i.e. the opening and closing times, of the gas exchange valves. By means of these devices, the phase relationship between the crankshaft and camshaft can be adjusted in a variable manner, within a defined angular range, between a maximum early position and maximum late position. Said device is integrated into a drive train via which torque is transmitted from the crankshaft to the camshaft. Said drive train can be realized, for example, in the form of a belt drive, chain drive or gear wheel drive. In addition to the camshaft, the device has a phase adjustment device which is connected to the camshaft in a rotationally fixed manner. The phase adjustment device can be designed, for example, as a pivoting motor of vane cell construction with a plurality of pressure chambers acting counter to one another. By means of pressure medium being supplied to one group of pressure chambers while pressure medium at the same time flows out of the other group of pressure chambers, the phase relationship of an impeller relative to a cell wheel of the phase adjustment device and therefore of the camshaft relative to the crankshaft can be adjusted in a variable manner. The flow of pressure medium to and from the pressure chambers is customarily regulated by means of a hydraulic directional-control proportional valve.

A device of this type is known, for example, from DE 10 2005 060 111 A1. In this embodiment, the phase adjustment device is screwed to a camshaft, which is of solid design, by means of a central screw in order to realize the rotationally fixed connection between the phase adjustment device and the camshaft.

A further device is known from DE 102 28 354 A1. In this embodiment, a cavity serving as a volume accumulator is provided within the camshaft, which is of solid design. In operating phases of the internal combustion engine, in which a sufficient amount of pressure medium is made available by a pressure medium pump of the internal combustion engine in order to operate the phase adjustment device, the volume accumulator is filled with pressure medium. If the pressure medium requirement of the phase adjustment device increases beyond the volumetric flow provided by the pressure medium pump, the volume accumulator assists the phase adjustment device.

OBJECT OF THE INVENTION

The present invention is based on the object of proposing a device having a high response characteristic and low outlay on production.

SUMMARY OF THE INVENTION

According to the invention, the object is achieved in that the housing is fixed in the cavity in a positionally fixed manner by means of a fastening element. An outer surface area of the fastening element is substantially matched to a surface area of the cavity, and the fastening element has at least one axially extending, first pressure medium passage. The pressure medium passage runs along the entire axial extent of the fastening element. Also, the housing has a pressure medium conducting structure which communicates at one end with the first pressure medium passage and at the other end with at least one bore of at least one camshaft bearing.

The device has a hydraulic consumer, for example a hydraulic valve-actuating device or a hydraulic phase adjustment device, a camshaft and a volume accumulator. The hydraulic consumer makes it possible for, for example, the valve lift or the timing of the gas exchange valves to be variably adjusted.

The camshaft is mounted rotatably in the internal combustion engine by means of camshaft bearings and has a cavity which communicates with the camshaft bearings via a plurality of bores. Furthermore, the volume accumulator is accommodated in the interior of the camshaft. The volume accumulator has a housing which extends in the region of at least one camshaft bearing. A fastening element is provided to fix the volume accumulator in place. An outer surface area of the fastening element is matched to a surface area of the cavity and may, for example, be fixedly connected to said surface area, for example by means of a screw connection or a frictional connection. In this connection, embodiments are conceivable, in which the fastening element is designed as a separate component. In these embodiments, the housing bears, for example, against an axial side surface of the fastening element, wherein a second fastening element is provided at the other end of the housing, said second fastening element pressing the housing against the first fastening element. As an alternative, the fastening element can be designed as a single part with the housing.

The fastening element has at least one axially extending, first pressure medium passage which runs along the entire axial extent of the fastening element and therefore hydraulically connects the region upstream and downstream of the fastening element. The pressure medium passage can be designed, for example, as an axially extending groove or indentation on the outer surface area of the fastening element, wherein the region of the groove or the indentation does not bear against the surface area of the cavity. The housing has a pressure medium conducting structure which communicates at one end with the first pressure medium passage and at the other end with at least one bore of at least one camshaft bearing. The pressure medium conducting structure can be realized, for example, as an annular gap between the outer surface area of the housing and the surface area of the cavity. Axially extending indentations are also conceivable. By means of this embodiment, the volume accumulator can be arranged within the camshaft, and therefore no additional construction space is required. At the same time, lubricant can be supplied to the camshaft bearings, likewise via the interior of the camshaft, and therefore no additional supply structures which are costly and take up construction space are required.

In a development of the invention, provision may be made for the external diameter of the housing to be smaller than the diameter of the cavity, and for the pressure medium conducting structure to be designed as an annular gap between the housing and the surface area of the cavity. The pressure medium conducting structure is therefore realized without additional costs, with it being ensured at the same time that the volume accumulator housing is not deformed as the latter is being installed in the cavity. Jamming of a displaceable piston arranged within the housing is therefore prevented.

Provision may be made here for the annular gap to be sealed off on the side facing away from the first fastening element by means of a second fastening element. As an alternative, the housing can have, on the side facing away from the first fastening element, a region, the external diameter of which is matched to the diameter of the cavity, and therefore, in this case, the sealing function is taken on by the housing itself. Lubricant can therefore enter the annular gap exclusively via the pressure medium passage or the first pressure medium passages and can only leave again via the camshaft bearings.

BRIEF DESCRIPTION OF THE DRAWINGS

Further features of the invention emerge from the description below and from the drawings in which exemplary embodiments of the invention are illustrated in simplified form. In the drawings.

DETAILED DESCRIPTION OF THE DRAWINGS

Figure 1:
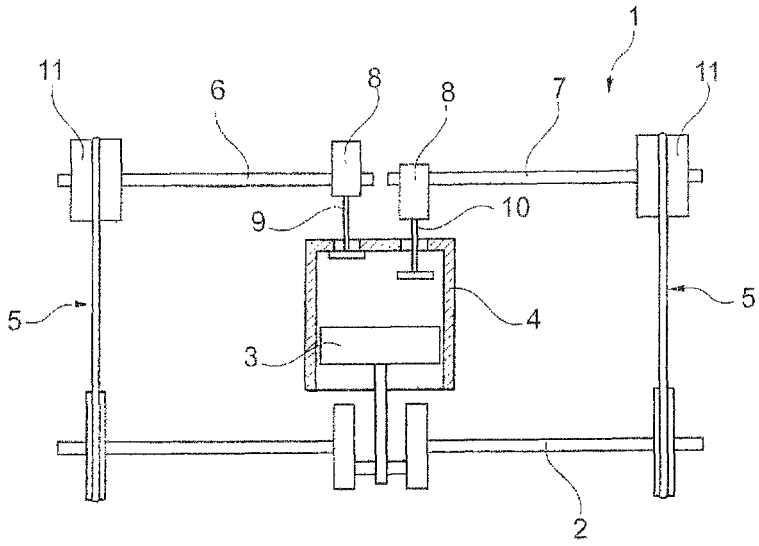
FIG. 1 shows, only highly schematically, an internal combustion engine.

An internal combustion engine is sketched in FIG. 1 with a piston 3, which is seated on a crankshaft 2, in a cylinder 4 being indicated. In the embodiment illustrated, the crankshaft 2 is connected via a respective traction mechanism drive 5 to an inlet camshaft 6 and outlet camshaft 7, wherein a first and second device 11 for the variable adjustment of valve lift curves of gas exchange valves 9, 10 of an internal combustion engine 1 can ensure a relative rotation between the crankshaft 2 and the camshaft 6, 7. Cams 8 of the camshafts 6, 7 actuate one or more inlet gas exchange valves 9 and one or more outlet gas exchange valves 10, respectively. Provision can also be made for only one of the camshafts 6, 7 to be equipped with a device 11, or for only one camshaft 6, 7 to be provided, which camshaft is provided with a device 11.

Figure 2:
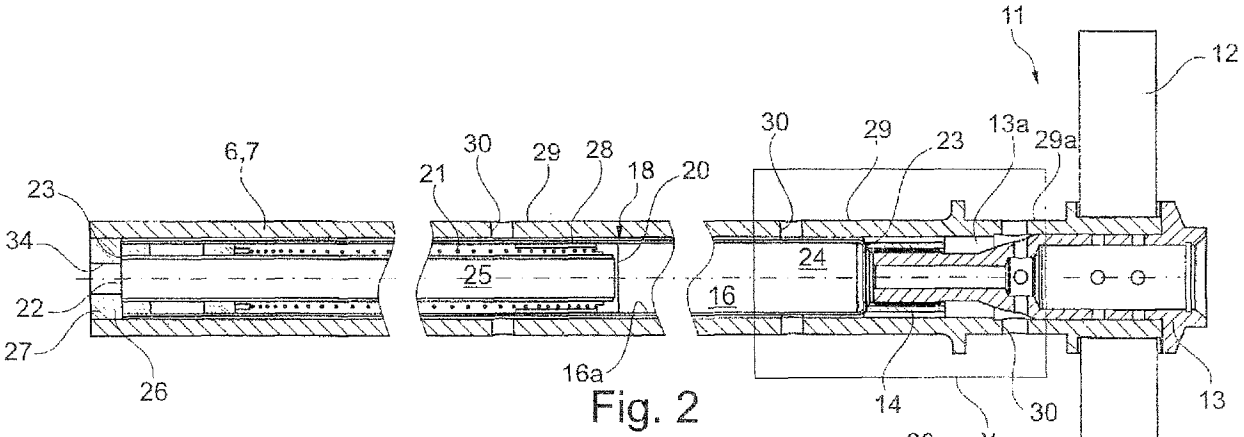
FIG. 2 shows a longitudinal section through a first embodiment according to the invention of a device.

FIG. 2 shows a first embodiment of a device 11 according to the invention in longitudinal section and cross section. The device 11 is a consumer 12, a phase adjustment device 12 in the embodiment illustrated, a camshaft 6, 7 and a volume accumulator 18. The phase adjustment device 12 is designed as a hydraulic actuator, wherein the latter is set into rotation by the crankshaft 2 by means of a traction mechanism drive 5 and is connected to the camshaft 6, 7 in a rotationally fixed manner. By means of the supply of pressure medium to a group of pressure chambers (not illustrated) of the hydraulic actuator of the phase adjustment device 12 while pressure medium simultaneously flows out of a second group of pressure chambers (likewise not illustrated), the phase position of the camshaft 6, 7 relative to the crankshaft 2 can be adjusted in a variable manner within a defined angular range. Phase adjustment devices 12 of this type are known among experts in the art and are disclosed, for example, in DE 42 18 082 A1 or DE 10 2005 060 111 A1.

The phase adjustment device 12 is arranged at an axial end of the camshaft 6, 7 and bears in the axial direction against an axial stop formed on the camshaft 6, 7. The phase adjustment device 12 is connected to the camshaft 6, 7 in a rotationally fixed manner by means of a central screw 13. For this purpose, the central screw 13 reaches through the phase adjustment device 12, wherein one end of the central screw 13 is formed with a collar extending in the radial direction. The collar bears against a side surface of the phase adjustment device 12, which side surface faces away from the camshaft 6, 7. A first thread 15 is formed at the other end of the central screw 13. The camshaft 6, 7 is designed as a hollow shaft and has a cavity 16 which extends along the entire camshaft 6, 7 and is bounded by a surface area 16*a*. A first fastening element 14 is arranged within the cavity 16 and is fastened to the camshaft 6, 7 in a positionally fixed manner, i.e. non-displaceably in the axial and radial direction. In the embodiment illustrated, this is realized by means of a press fit between an outer surface area of the fastening element 14 and the surface area 16*a*. The first fastening element 14, has, in a central passage bore, a second thread 17 in which the first thread 15 of the central screw 13 engages such that the phase adjustment device 12 is connected to the camshaft 6, 7 in a rotationally fixed manner.

A volume accumulator 18 is arranged with the cavity 16 of the camshaft 6, 7. The volume accumulator 18 has a housing 19, a separating element 20 which is designed as a piston 20, and a spring element 21. The housing 19 is of substantially hollow-cylindrical design with a respective opening 22 on each axial end side, wherein the housing 19 extends radially inward at the axial ends 23 thereof. The external diameter of the housing 19 is designed to be smaller than the diameter of the cavity 16.

The piston 20 is designed as a thin-walled, cup-shaped sheet-metal component and is mounted in an axially displaceable manner within the housing 19. The piston 20 here separates the interior of the housing 19 into a supply space 24 and a complementary space 25.

The spring element 21 is arranged in the complementary space 25 and is supported at one end on that side of the piston 20 which faces away from the supply space 24 and at the other end on that region of the housing 19 which extends radially inward.

Figure 3:
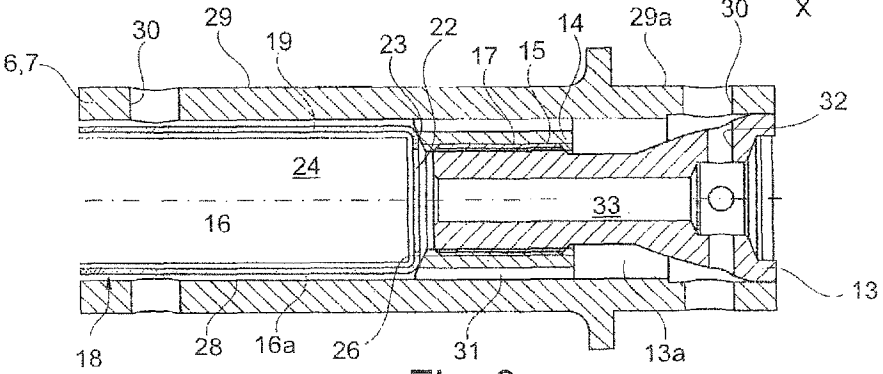
FIG. 3 shows an enlarged illustration of the detail X from FIG. 2.

The axial ends 23 of the housing 19 each bear against a conical hearing surface 26 (FIGS. 2 and 3). The first conical bearing surface 26 is designed as an internal cone on that side of the first fastening element 14 which faces away from the phase adjustment device 12. The second bearing surface 26 is formed on a second fastening element 27 which is connected to the camshaft 6, 7 in a positionally fixed manner and is arranged at that end of the housing which faces away from the phase adjustment device 12. In this case, the second bearing surface 26 is designed as an external cone. The volume accumulator 18 is fixed in the axial direction in the cavity 16 by the housing 19 bearing against the conical bearing surfaces 26 and is centered with respect to the longitudinal axis of the camshaft 6, 7. Since the external diameter of the housing 19, which is of substantially hollow-cylindrical design, is designed to be smaller than the diameter of the surface area 16*a*, an annular gap 28 acting as a pressure medium conducting structure 28 is realized between the housing 19 and the surface area 16*a*. There is therefore no risk of the housing 19 being deformed by unevennesses on the surface area 16*a* during the positioning in the cavity 16. It is ensured as a result that the piston 20 does not become jammed within the housing 19 but rather is displaceable smoothly. Costly and time-consuming re-machining of the surface area 16*a* of the camshaft 6, 7 is therefore not needed.

Figure 4:
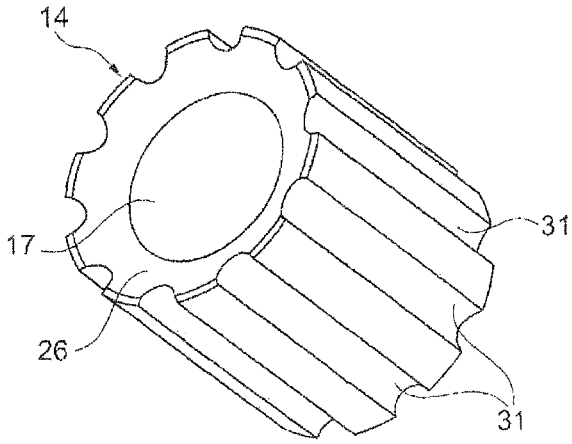
FIG. 4 shows a perspective illustration of a fastening element.

The annular gap 28 extends from the first fastening element 14 along the entire camshaft 6, 7 and in particular covers a plurality of camshaft bearings 29. In the region of the camshaft bearings 29, a plurality of bores 30 are formed in each case on the camshaft 6, 7, said bores communicating at one end with the annular gap 28 and at the other end with respective camshaft bearing 29. The annular gap 28 is sealed off in the axial direction by the second fastening element 27. The first fastening element 14 has, on the outer surface area thereof, first pressure medium passages 31 in the form of grooves extending in the axial direction (FIG. 4) such that the annular gap 28 communicates with a receiving region 13*a* of the cavity 16, in which the central screw 13 is arranged.

During the operation of the internal combustion engine 1, pressure medium which is delivered by a pressure medium pump (not illustrated) is supplied to the receiving region 13*a* via bores 30 formed on the camshaft 6, 7 in the region of the first camshaft bearing 29*a*. At the same time, lubricant is supplied to the first camshaft bearing 29*a*. The pressure medium passes via the first pressure medium passages 31, the annular gap 28 and the bores 30 to the camshaft bearings 29. The second fastening element 27 here prevents pressure medium from emerging on that side of the camshaft 6, 7 which faces away from the phase adjustment device 12. The first pressure medium passages 31, the annular gap 28 and/or the bores 30 are designed in such a manner that they throttle the stream of lubricant to the camshaft bearings 29, but with sufficient lubrication of the camshaft bearings 29 being ensured.

At the same time, the pressure medium enters the interior of the central screw 13, which is of hollow design, via screw openings 32. Within the central screw 13, the pressure medium firstly passes to the phase adjustment device 12 via a hydraulic directional-control proportional valve (not illustrated) arranged in the interior of the central screw 13. Directional-control proportional valves of this type are known, for example, from DE 10 2005 052 481 A1. Furthermore, upon sufficient supply of pressure medium to the phase adjustment device 12, excess pressure medium passes via a second pressure medium passage 33 formed in the central screw 13 to that opening 22 in the housing 19 of the volume accumulator 18 which is on the supply-space side and is supplied to the supply space 24. As a result, the piston 20 is displaced counter to the force of the spring element 21, and therefore the volume of the supply space 24 increases at the cost of the volume of the complementary space 25. If the volume of pressure medium required by the phase adjustment device 12 exceeds the volume of pressure medium delivered by the pressure medium pump the piston 20 is displaced in the opposite direction owing to the force exerted on the said piston by the spring element 21, and therefore the pressure medium stored in the supply space 24 is supplied to the phase adjustment device 12 via the second pressure medium passage 33.

Thus, pressure medium is supplied to the phase adjustment device 12, the volume accumulator 18 and the camshaft bearings 29 via the interior of the camshaft 6, 7, with additional components not being required. A separate supply of pressure medium to the camshaft bearings 29 is not required.

The second fastening element 27 has an axially extending, central passage opening 34 via which the complementary space 25 communicates with the interior of the internal combustion engine 1. Air and pressure medium can therefore escape from the complementary space 25.

Figure 5:
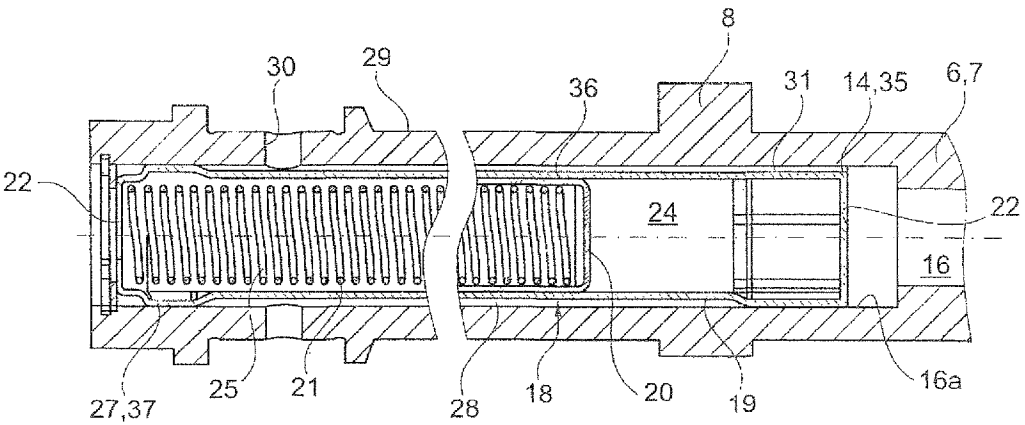
FIG. 5 shows a longitudinal section through the camshaft of a second embodiment according to the invention of a device.

FIG. 5 shows a longitudinal section through a camshaft 6, 7 of a second embodiment of a device 11. In contrast to the first embodiment, the fastening element 14 is designed as a single part with the housing 19. On the phase adjustment device side, the housing 19 has a first region 35, the external diameter of which is matched to the diameter of the surface area 16*a* and is connected frictionally to said diameter. The first region 35 has axially extending pressure medium passages 31 which are designed in the form of radial indentations.

The first region 35 is adjoined by a second region 36, the external diameter of which is designed to be smaller than the diameter of the cavity 16. A pressure medium conducting structure is therefore designed in the form of an annular gap 28. The second region 36 and therefore the annular gap 28 extend along the entire region of the camshaft 6, 7, in which the camshaft bearings 29 are arranged. The annular gap 28 therefore communicates on one side with the first pressure medium passages 31 and on the other side with the camshaft bearings 29 via the bores 30.

The second region 36 is adjoined by a third region 37, the external diameter of which is matched to the diameter of the cavity 16. In the embodiment illustrated, the third region 37 is connected frictionally to the surface area 16*a* such that said region acts as second fastening element 27. The third region 37 therefore seals off the annular gap 28 in the axial direction.

During the operation of the internal combustion engine 1, pressure medium passes, as in the first embodiment, via the receiving region 13*a* to the supply space 24 of the volume accumulator 18, to the phase adjustment device 12 and, via the first pressure medium passages 31, the annular gap 28 and the bores 30, to the camshaft bearings 29. Therefore, a device 11 is again realized, the volume accumulator 18 of which is arranged in the camshaft 6, 7, with it being possible at the same time for the lubricant to be supplied to the camshaft bearings 29 via the interior of the camshaft 6, 7. The volume accumulator 18 is therefore arranged in a neutral manner in terms of construction space and in the spatial vicinity of the consumer 12—the phase adjustment device 12, with there not being any need at the same time for a separate supply of pressure medium to the camshaft hearings 29.

REFERENCE NUMBERS

1. Internal combustion engine
2 Crankshaft
3 Piston
4 Cylinder
5 Traction mechanism drive
6 Inlet camshaft
7 Outlet camshaft
8 Cam
9 Inlet gas exchange valve
10 Outlet gas exchange valve
11 Device
12 Phase adjustment device
13 Central screw
13*a* Receiving region
14 First fastening element
15 First thread
16 Cavity
16*a* Surface area
17 Second thread
18 Volume accumulator
19 Housing
21 Spring element
22 Opening
23 Axial end
24 Supply space
25 Complementary space
26 Bearing surface
27 Second fastening element
28 Annular gap
29 Camshaft bearing
29*a* First camshaft bearing
30 Bore
31 First pressure medium passage
32 Screw opening
33 Second pressure medium passage
34 Passage opening
35 First region
36 Second region
37 Third region

The invention claimed is:

1. A device for variable adjustment of valve lift curves of gas exchange valves of an internal combustion engine, comprising:

a hydraulic consumer;

a camshaft having an interior with a cavity, camshaft bearings, and bores, the camshaft being arranged in the internal combustion engine in a rotatably mounted manner via the camshaft bearings, the bores being formed in the camshaft in a region of the camshaft bearings so that the cavity communicates with the camshaft bearings;

a volume accumulator arranged in the cavity and having a housing which extends in a region of at least one of the camshaft bearings, the housing being a separate element from the camshaft and received in the cavity of the camshaft; and a fastening element arranged to fix the housing in the cavity in a positionally fixed manner, the fastening element having an outer surface area that is substantially matched to a surface area of the cavity and at least one axially extending first pressure medium passage that extends along an entire axial extent of the fastening element, the housing having a pressure medium conducting structure which communicates at one end with the first pressure medium passage and at another end with at least one of the bores of at least one of the camshaft bearings.

2. The device according to claim 1, wherein the fastening element is a separate component.

3. The device according to claim 1, wherein the fastening element is a single part with the housing.

4. The device according to claim 1, wherein the housing has an external diameter which is smaller than a diameter of the cavity, and the pressure medium conducting structure is an annular gap between the housing and the surface area of the cavity.

5. The device according to claim 4, and further comprising a further fastening element arranged so as to seal the annular gap on a side facing away from the fastening element.

6. The device according to claim 5, wherein the housing has, on the side facing away from the fastening element, a region with an external diameter that is matched to a diameter of the cavity.

7. The device according to claim 1, wherein the volume accumulator further comprises a piston axially displaceably mounted in the housing and separating an interior of the housing into a supply space and a complementary space.

8. The device according to claim 7, further comprising a spring disposed in the complementary space and exerts force on the piston.

* * * * *